US007665527B2

(12) United States Patent
Loretz

(10) Patent No.: US 7,665,527 B2
(45) Date of Patent: Feb. 23, 2010

(54) PROVIDING A RECHARGEABLE HYDRAULIC ACCUMULATOR IN A WELLBORE

(75) Inventor: Ives D. Loretz, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 232 days.

(21) Appl. No.: 11/842,245

(22) Filed: Aug. 21, 2007

(65) Prior Publication Data

US 2009/0050373 A1 Feb. 26, 2009

(51) Int. Cl.
*E21B 34/08* (2006.01)

(52) U.S. Cl. ..... 166/373; 166/319; 166/386

(58) Field of Classification Search ..... 166/373, 166/374, 386, 319, 320
See application file for complete search history.

(56) References Cited

U.S. PATENT DOCUMENTS 4,821,799 A * 4/1989 Wong ..... 166/84.2
6,851,481 B2 * 2/2005 Vinegar et al. ..... 166/374
7,219,728 B2 5/2007 Veneruso
7,231,971 B2 6/2007 McCalvin
2006/0191681 A1 8/2006 Storm
2006/0191682 A1 8/2006 Storm
2006/0191687 A1 8/2006 Storm

FOREIGN PATENT DOCUMENTS

WO 2006060673 6/2006
WO 2006060708 6/2006
WO 2006065559 6/2006

* cited by examiner

*Primary Examiner*—Giovanna C Wright
(74) *Attorney, Agent, or Firm*—Rodney Warfford; Daryl R. Wright; Trop, Pruner & Hu PC

(57) ABSTRACT

A rechargeable hydraulic accumulator is provided in a wellbore, and a component is actuated by discharging the hydraulic accumulator. The hydraulic accumulator is recharged by increasing pressure in a fluid conduit.

24 Claims, 4 Drawing Sheets

PROVIDING A RECHARGEABLE HYDRAULIC ACCUMULATOR IN A WELLBORE

TECHNICAL FIELD

This invention relates generally to providing a rechargeable hydraulic accumulator for actuating a component in a wellbore.

BACKGROUND

To complete a wellbore, various equipment can be installed in the wellbore to allow for the production or injection of fluids from or to reservoirs surrounding the wellbore. Examples of reservoirs include hydrocarbon reservoirs, water aquifers, gas injection zones, and so forth.

The completion equipment provided in a wellbore has various components that may have to be actuated using some type of an actuating mechanism. Examples of components that are actuated include flow control devices, packers, and other types of downhole devices.

Typical actuating mechanisms for actuating downhole devices include electrical actuating mechanisms, hydraulic actuating mechanisms, mechanical actuating mechanisms, and so forth. In many cases, additional control lines, such as additional hydraulic control lines or electrical control lines, have to be run into a wellbore to allow for activation of such actuating mechanisms. This can serve to convey power as well as the control signals to activate downhole mechanisms. Running additional control lines can be relatively expensive.

SUMMARY

In general, according to an embodiment, a method for use in a wellbore includes providing a rechargeable hydraulic accumulator in the wellbore, and actuating a component in the wellbore by discharging the hydraulic accumulator. The hydraulic accumulator is recharged by increasing pressure in a fluid conduit.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
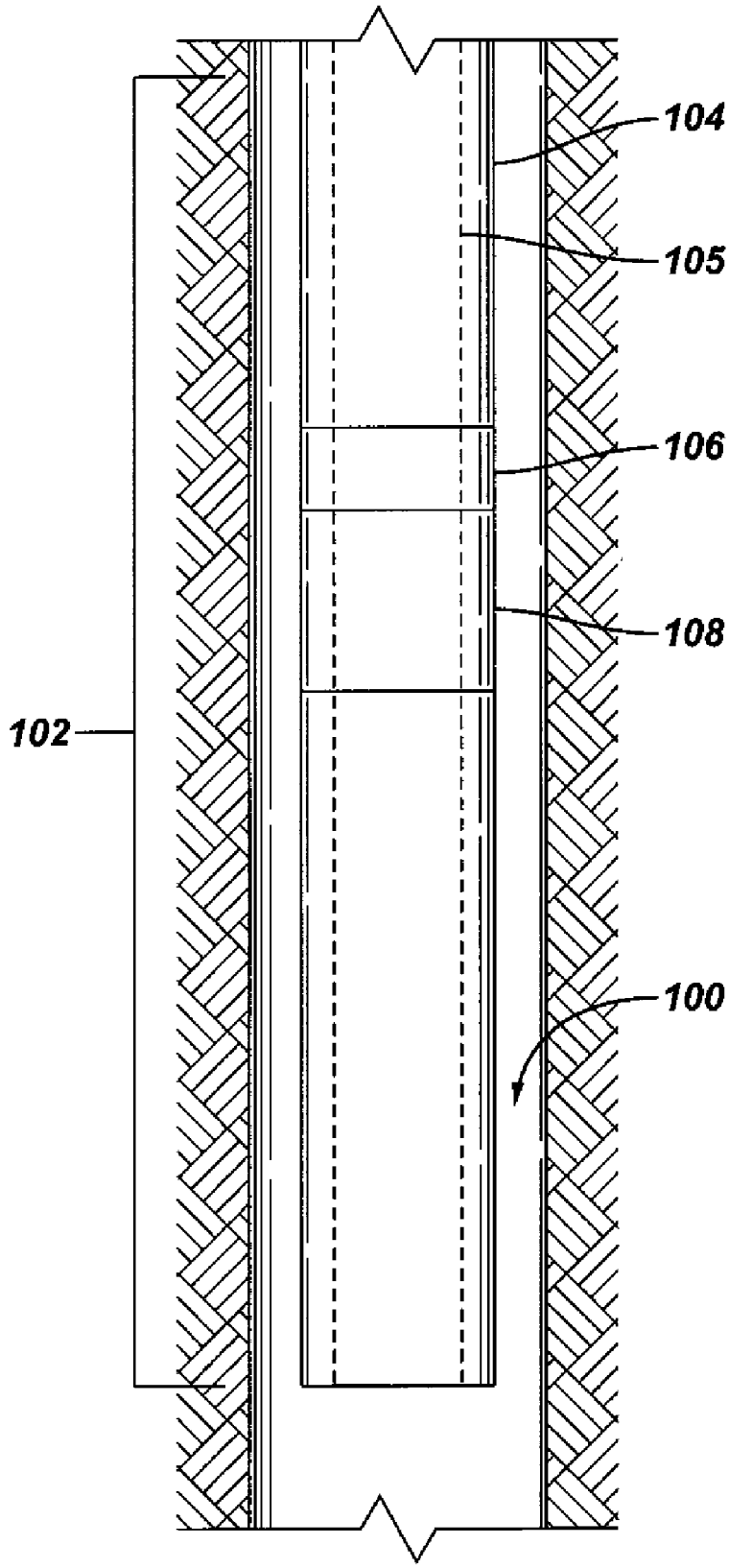
FIG. 1 illustrates an example completion system deployed in a wellbore in which some embodiments of the invention can be incorporated.

FIG. 1 illustrates an example completion system 102 that is deployed in a wellbore 100. The completion system 102 includes a tubing 104 (e.g., production tubing or injection tubing) that has an inner flow conduit 105 through which fluids (production fluids or injection fluids) from a reservoir or directed to a reservoir adjacent the wellbore can flow. Attached to the tubing 104 is a flow control device 108 (in the form of a valve) that can be set at a closed position, an open position, and optionally one or more intermediate positions.

In accordance with some embodiments, the actuating mechanism used for operating the valve 108 is a rechargeable hydraulic accumulator 106. A "hydraulic accumulator" refers to a hydraulic device that is able to store potential energy that when released provides hydraulic activation pressure to enable activation of a downhole component. Discharging the hydraulic accumulator 106 provides the energy source that is used for actuating the valve 108 between different positions of the valve 108. However, the hydraulic accumulator 106, after discharge, can be recharged, such as by increasing pressure in the flow conduit 105 of the tubing 104. The increased pressure in the flow conduit 105 is communicated to a chamber of the hydraulic accumulator 106 to allow for recharging of the hydraulic accumulator so that the hydraulic accumulator can later be used for further operation of the valve 108 (or of another downhole component).

In other embodiments, other types of components can be actuated by the rechargeable accumulator 106. Note that the rechargeable accumulator can also be used to provide energy to activate multiple downhole components.

Alternatively, instead of using pressure provided in the flow conduit 105 of the tubing 104 to recharge the hydraulic accumulator, increased pressure can be provided in another conduit, such as an existing hydraulic control line, to allow for recharging of the hydraulic accumulator 106.

Figure 2:
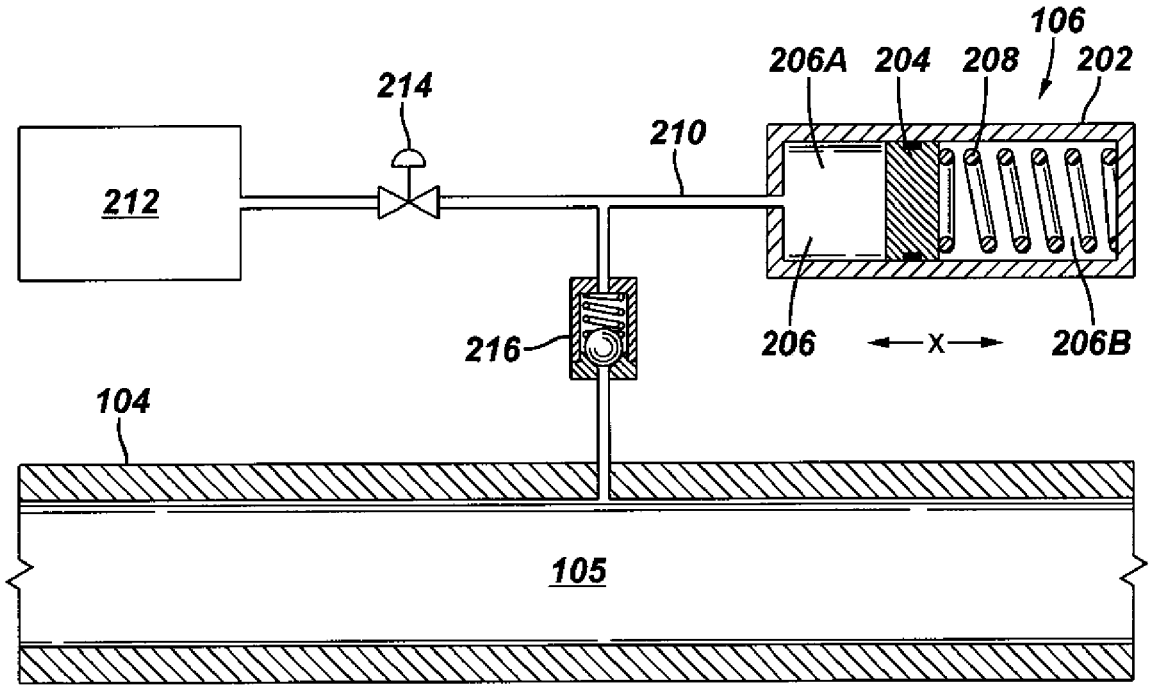
FIGS. 2-4 illustrate various embodiments of rechargeable accumulators.

FIG. 2 shows an example arrangement that includes a rechargeable hydraulic accumulator 106 according to an embodiment. The rechargeable hydraulic accumulator 106 has an outer housing 202 and a movable piston 204 provided in a chamber 206 defined inside the housing 202. The piston 204 is moveable in a longitudinal direction (indicated as x) of the accumulator 200.

The piston 204 separates the chamber 206 of the accumulator 106 into two sub-chambers 206A and 206B, where the sub-chamber 206B includes a compressible medium such as a mechanical spring 208. Alternatively, the compressible medium can be compressible gas or some other type of compressible fluid or solid. In another example, the compressible medium is a bladder that can be provided in the sub-chamber 206B, where the bladder can be compressed by movement of the piston 204 against the bladder.

Pressurized fluid is provided into the sub-chamber 206A of the accumulator 200 to move the piston 204 against the compressible medium to store potential energy. At some later point in time, the pressurized fluid in the sub-chamber 206A can be released (discharged) to allow the compressible medium in the sub-chamber 206B to move the piston 204 in the other direction (towards the sub-chamber 206A) to cause the application of hydraulic energy against a component 212 (which can be the valve 108 of FIG. 1 or some other component).

A control line 210 extends from the sub-chamber 206A to the component 212 through an optional control valve 214. When the control valve 214 is opened, the force applied by the compressible medium 208 against the piston 204 forces the pressurized fluid in the sub-chamber 206A against the component 212 to cause actuation of the component 212.

As further depicted in FIG. 2, a check valve 216 is provided to enable communication of fluid pressure in the tubing conduit 105 and the accumulator sub-chamber 206A. When the pressure applied in the tubing conduit 105 is greater than the pressure of the control line 210 (which is the pressure of the sub-chamber 206A), the check valve 216 opens to allow the pressurized fluid in the tubing conduit 105 to flow into the sub-chamber 206A. The pressurized fluid flows through the check valve 216 and the control line 210 to recharge the accumulator 106.

The check valve 216 and the control line segment 210 constitute one example of a recharging mechanism used to recharge the hydraulic accumulator 106 in response to increased pressure in the conduit 105. In other implementations, other recharging mechanisms can be used.

The rechargeable hydraulic accumulator 106, according to some embodiments, can be recharged repeatedly to allow for the provision of power or force for operating the downhole component 212 for as long as the completion system remains in the wellbore, which can be many years. By using a local energy source in the form of the rechargeable hydraulic accumulator 106, large amounts of power or energy do not have to be communicated all the way from the earth surface, which can be difficult using traditional conveyance mechanisms, such as electric or fiber optic lines. Moreover, even though hydraulic control lines that extend from the earth surface can deliver relatively large amounts of power, hydraulic control lines are difficult to use for selectively controlling multiple components in the wellbore and they add complexity and cost to an installation.

By using one or more rechargeable hydraulic accumulators according to some embodiments, long-term and moderate amounts of power can be provided to operate one or more downhole components without the use of an extra hydraulic control line that extends from the earth surface. Each hydraulic accumulator can be installed pre-charged, and can be recharged as needed and as many times as needed.

Figure 3:
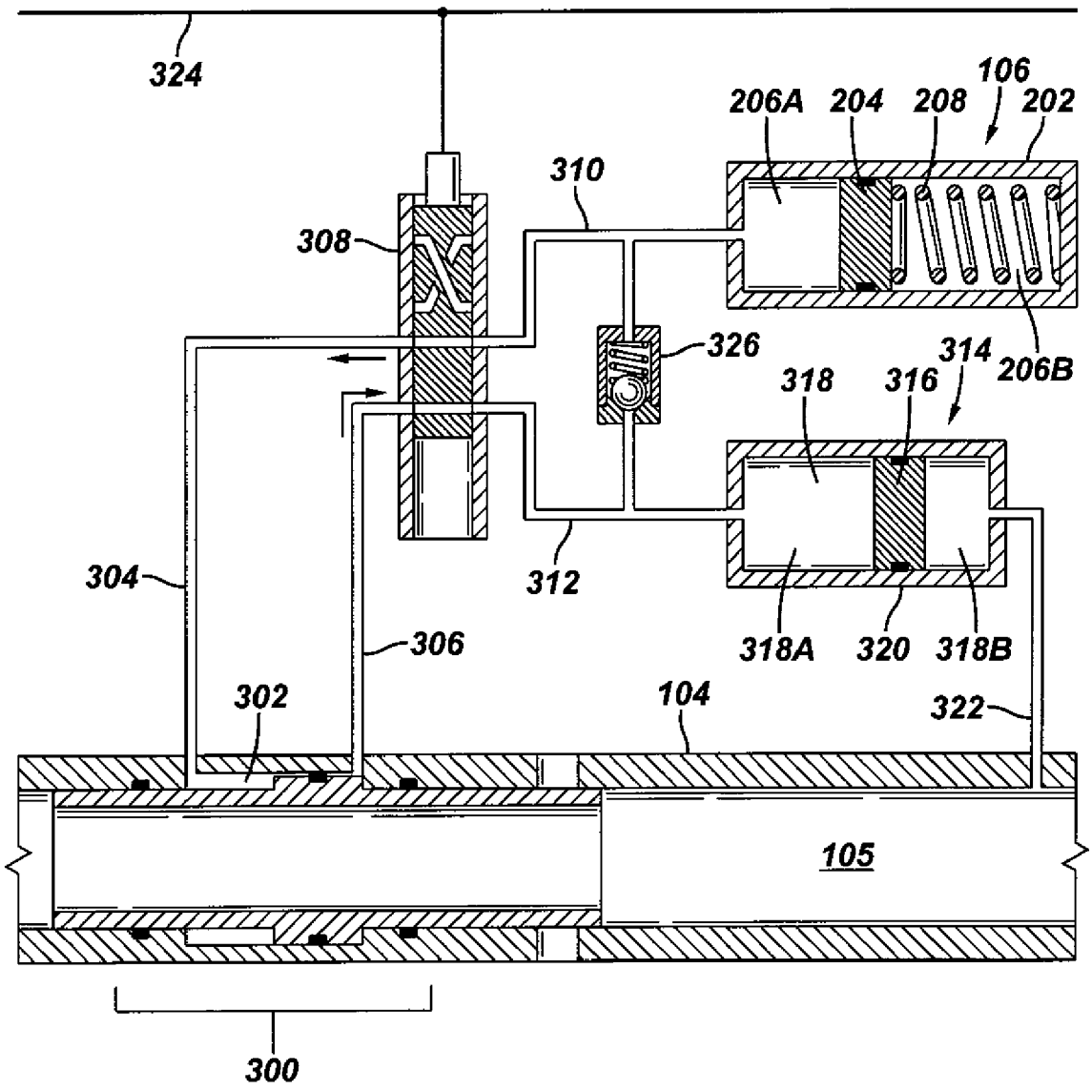

FIG. 3 shows an alternative arrangement that includes the rechargeable hydraulic accumulator 106. In this example embodiment, two control line segments 304 and 306 are provided to the two sides of a sleeve valve 300, which includes a moveable sleeve 302. A first control line segment 304 is provided to one side of the sleeve 302, while a second control line segment 306 is provided on the other side of the sleeve 302. Controlling the selective application of pressure in the control line segments 304 and 306 is used for controlling the movement of the sleeve 302 for opening or closing the sleeve valve 300.

The control lines 304 and 306 are provided to an electro-hydraulic valve 308, which is connected by control line segments 310 and 312 to the accumulator 106 and a fluid barrier device 314, respectively. The control line segment 310 is hydraulically connected to the accumulator sub-chamber 206A.

The fluid barrier device 314 has a free-floating piston 316 that divides a chamber 318 defined within a housing 320 of the fluid barrier device 314 into a first sub-chamber 318A and a second sub-chamber 318B. The first sub-chamber 318A is hydraulically connected to the control line segment 312, whereas the sub-chamber 318B is hydraulically connected to another control line segment 322 that is hydraulically connected to the tubing inner conduit 105.

The electro-hydraulic valve 308 (which can be a solenoid valve) is controlled by electrical signaling provided over an electrical cable 324. Note that the power requirement of the electric cable 324 can be relatively low since the electro-hydraulic valve 308 is a relatively low-power device. The power requirement of the electro-hydraulic valve 308 is lower than the power requirement of the sleeve valve 300. As a result, lower power can be provided over the cable 324 to operate the electro-hydraulic valve 308 than would be required to operate the valve 300 directly.

During operation, the electro-hydraulic valve 308 is operated to allow for potential energy accumulated in the accumulator 106 to apply hydraulic pressure in the sub-chamber 206A through the control line segment 310, electro-hydraulic valve 308, and control line segment 304 to the sleeve valve 300. To recharge the accumulator 106, the fluid pressure in the tubing conduit 105 can be increased to cause increased pressure in the sub-chamber 318B of the fluid barrier device 314 (as communicated through the hydraulic control line segment 322). This causes the piston 316 of the fluid barrier device 314 to move towards the sub-chamber 318A to cause application of the increased pressure through a check valve 326 to the sub-chamber 206A of the accumulator 106. This in turn causes the piston 204 of the accumulator 106 to move against the compressible medium 208 and compress the compressible medium 208 to store potential energy.

In the example of FIG. 3, the recharging mechanism to recharge the hydraulic accumulator 106 includes the control line segment 322, fluid barrier device 314, control line segments 312 and 310, and check valve 326.

The electro-hydraulic configuration requires only one control line (electrical cable 324) from the earth surface, which can be beneficial when multiple control lines cannot easily be deployed (such as in a lateral well or due to limited packer penetrations). Also, the provision of one control line saves cost since long fluid conduits (e.g. control lines) may be more expensive than downhole power storage devices.

Figure 4:
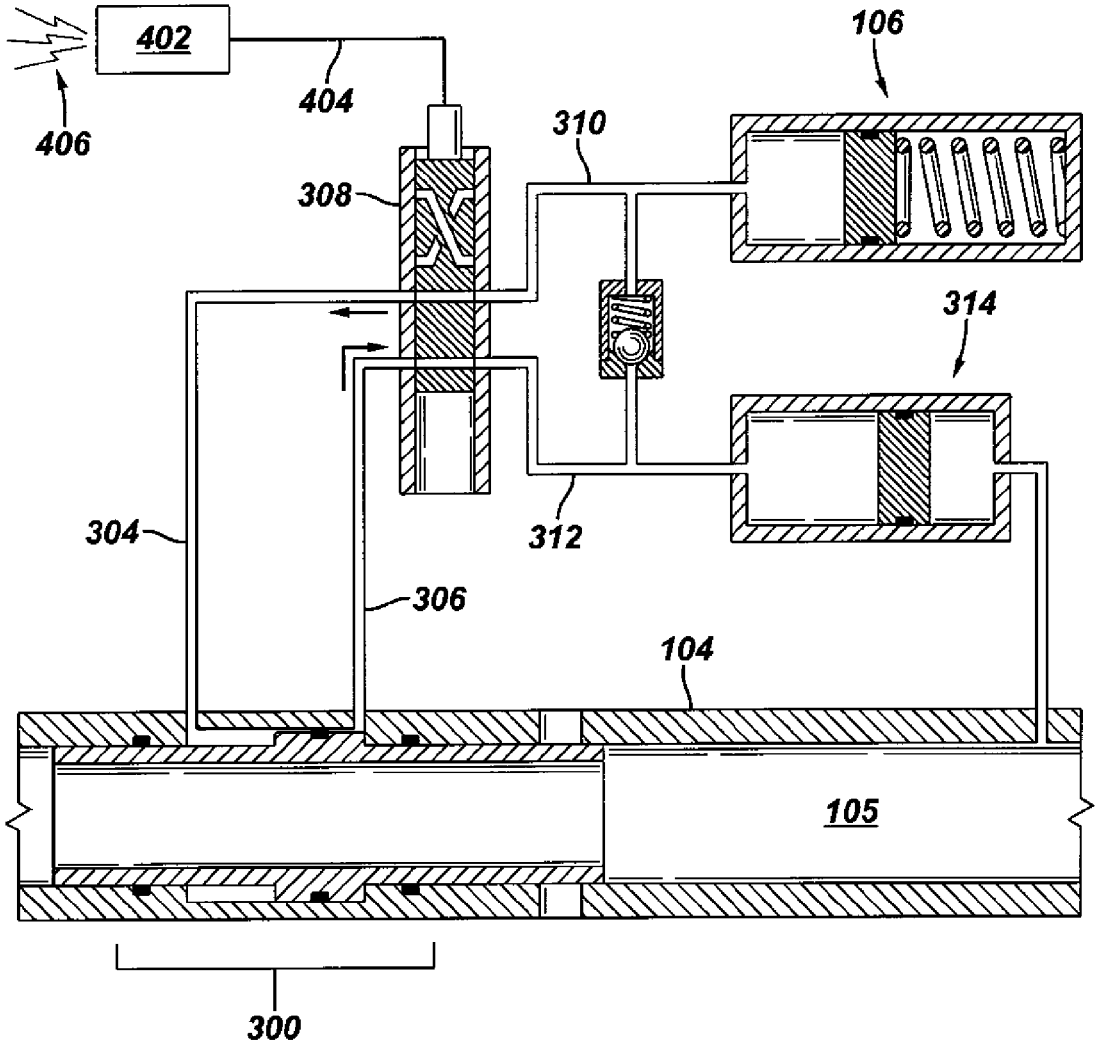

In another embodiment, as depicted in FIG. 4, instead of using the electrical cable 324 of FIG. 3, a downhole wireless communications module 402 can be provided to communicate wirelessly with either the earth surface or with some other downhole controller. The downhole wireless control module 402 is electrically connected over a cable segment 404 to the electro-hydraulic valve 308. Wireless communication 406 performed by the downhole wireless control module 402 can involve electromagnetic (EM) communications, acoustic communications, pressure pulse communications, and so forth.

In operation, surface equipment for a downhole controller can send a command through the downhole wireless control module 402 for operating the electro-hydraulic valve 308. This can allow the communication of pressure from the accumulator 106 through control line segment 310, the valve 308, and control line segment 304 to the flow control valve 300.

The use of renewable energy source in the embodiment of FIG. 4 may be seen as particularly beneficial because power budgets of wireless modules are typically even more stringent than those of the examples given in FIGS. 2 and 3.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method for use in a wellbore, comprising:

providing a rechargeable hydraulic accumulator in the wellbore;

actuating a component in the wellbore by discharging the hydraulic accumulator; and recharging the hydraulic accumulator in response to increasing pressure in a fluid conduit that is one of a production tubing and injection tubing, the production tubing to produce fluids from a reservoir adjacent the wellbore, and the injection tubing to direct fluids into the reservoir.

2. The method of claim 1, wherein providing the hydraulic accumulator in the wellbore comprises providing the hydraulic accumulator that has a compressible medium.

3. The method of claim 2, wherein recharging the hydraulic accumulator comprises using the increased pressure in the fluid conduit to compress the compressible medium.

4. The method of claim 3, wherein compressing the compressible medium comprises compressing one of a spring, pressurized compressible fluid, and bladder.

5. The method of claim 3, wherein compressing the compressible medium comprises applying pressure against a piston in the hydraulic accumulator to compress the compressible medium.

6. The method of claim 5, wherein applying the pressure against the piston in the hydraulic accumulator comprises communicating the increased pressure in the fluid conduit through a check valve for application against the piston.

7. The method of claim 1, wherein discharging the hydraulic accumulator comprises activating a control valve to allow stored hydraulic energy in the hydraulic accumulator to be applied through the control valve to the component.

8. The method of claim 7, wherein activating the control valve comprises activating an electro-hydraulic control valve.

9. The method of claim 8, wherein activating the electro-hydraulic control valve comprises activating the electro-hydraulic control valve using a wireless control module or mechanism.

10. A method for use in a wellbore, comprising:

providing a rechargeable hydraulic accumulator in the wellbore;

actuating a component in the wellbore by discharging the hydraulic accumulator;

recharging the hydraulic accumulator in response to increasing pressure in a fluid conduit; and providing a fluid barrier device having a free-floating piston between the fluid conduit and at least one control line segment that is located between the fluid barrier device and the hydraulic accumulator, wherein increasing the pressure in the fluid conduit causes movement of the free-floating piston to transfer the increased pressure through the at least one control line segment to the hydraulic accumulator.

11. The method of claim 10, wherein the hydraulic accumulator has a second piston, wherein increasing the pressure in the fluid conduit causes the free-floating piston to be moved to apply increased pressure through the at least one control line segment to the hydraulic accumulator for urging the second piston of the hydraulic accumulator against a compressible medium in the hydraulic accumulator.

12. The method of claim 10, wherein recharging the hydraulic accumulator by increasing pressure in the fluid conduit comprises recharging the hydraulic accumulator by increasing pressure in a conduit of one of a production tubing and injection tubing, the production tubing to produce fluids from a reservoir adjacent the wellbore, and the injection tubing to direct fluids into the reservoir.

13. An apparatus for use in a wellbore, comprising:

a rechargeable hydraulic accumulator;

a component to be actuated by discharging the hydraulic accumulator;

a fluid conduit that is one of a production tubing and injection tubing, the production tubing to produce fluids from a reservoir adjacent the wellbore, and the injection tubing to direct fluids into the reservoir; and a recharging mechanism to recharge the hydraulic accumulator by increasing pressure in the fluid conduit.

14. The apparatus of claim 13, wherein the component comprises a valve, and wherein discharging the hydraulic accumulator causes hydraulic energy to be provided to actuate the valve.

15. The apparatus of claim 13, wherein the recharging mechanism comprises a check valve and a control line segment, and wherein the increased pressure in the fluid conduit is communicated through the check valve and the control line segment to the hydraulic accumulator.

16. The apparatus of claim 13, wherein the recharging mechanism comprises a check valve, at least one control line segment, and a fluid barrier device having a free-floating piston, and wherein the increased pressure in the fluid conduit causes movement of the free-floating piston to transfer the increased pressure through the check valve and at least one control line segment to the hydraulic accumulator.

17. The apparatus of claim 16, wherein the hydraulic accumulator comprises a second piston and a compressible medium, and wherein the recharging mechanism causes application of pressure against the second piston to compress the compressible medium in response to the increased pressure in the fluid conduit.

18. The apparatus of claim 13, further comprising a control valve to enable communication of hydraulic energy in the hydraulic accumulator to the component.

19. The apparatus of claim 18, wherein the control valve comprises an electro-hydraulic valve.

20. The apparatus of claim 18, further comprising a wireless control module to activate the control valve.

21. A system for use in a wellbore, comprising:

a tubing to carry at least one of production fluid from a reservoir adjacent the wellbore and injection fluid to be directed into the reservoir;

a rechargeable hydraulic accumulator for deployment in the wellbore;

a component for use in the wellbore, the component to be actuated by discharging the hydraulic accumulator; and a recharging mechanism to recharge the hydraulic accumulator by increasing pressure in a conduit of the tubing.

22. The system of claim 21, wherein the hydraulic accumulator has a first sub-chamber and a second sub-chamber divided by a piston, and a compressible medium in the first sub-chamber to be compressed by the piston in response to recharging performed by the recharging mechanism.

23. The system of claim 21, wherein the recharging mechanism comprises a check valve and at least one hydraulic control line segment.

24. The system of claim 21, wherein the recharging mechanism includes at least one control line segment and a barrier device having a free-floating piston, wherein the free-floating piston is configured to be moved in response to the increased pressure in the conduit of the tubing, wherein movement of the free-floating piston transfers the increased pressure to the at least one control line segment for communication to the hydraulic accumulator.

* * * * *